US006484006B2

(12) United States Patent
Izumi et al.

(10) Patent No.: US 6,484,006 B2
(45) Date of Patent: Nov. 19, 2002

(54) DEVELOPING DEVICE WITH DEVELOPER LAYER REGULATING BLADE

(75) Inventors: Takao Izumi, Kanagawa-ken (JP); Shinji Aoki, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 14 days.

(21) Appl. No.: 09/750,143

(22) Filed: Dec. 29, 2000

(65) Prior Publication Data

US 2002/0085861 A1 Jul. 4, 2002

(51) Int. Cl.[7] ..... G03G 15/08
(52) U.S. Cl. ..... 399/284
(58) Field of Search ..... 399/284, 286, 399/274, 275, 276

(56) References Cited

U.S. PATENT DOCUMENTS

| | | | | | |
|---|---|---|---|---|---|
| 4,566,402 | A | * | 1/1986 | Shimazaki | 399/284 |
| 4,579,081 | A | * | 4/1986 | Kohyama | 399/119 |
| 5,649,197 | A | * | 7/1997 | Fujita | 399/260 |
| 5,895,150 | A | * | 4/1999 | Watabe et al. | 118/261 |
| 5,937,253 | A | * | 8/1999 | Shimazaki et al. | 118/261 |
| 6,301,461 | B1 | * | 10/2001 | Sirejacob | 399/274 |

FOREIGN PATENT DOCUMENTS

| | | | | |
|---|---|---|---|---|
| JP | 05027581 A | * | 2/1993 | G03G/15/08 |
| JP | 5-241432 | | 9/1993 | |
| JP | 06348119 A | * | 12/1994 | G03G/15/08 |
| JP | 8-240987 | | 9/1996 | |

* cited by examiner

*Primary Examiner*—Robert Beatty
(74) *Attorney, Agent, or Firm*—Foley & Lardner

(57) ABSTRACT

A developing roller that supplies developing agent onto an electrostatic latent image on an image carrier, and a layer regulating blade that pressure contacts the developing roller and regulates a uniform layer thickness of the developing agent that is supplied to the developing roller are arranged, and an elastic resin coat layer whose thickness t is $10 \times a \leqq t \leqq 300$ [$\mu$m] is coated on the surface of the layer regulating blade, when the surface of the above developing roller is formed of a metallic material whose surface roughness Rz is a [$\mu$m], and the layer regulating blade is made of a metallic material. While, the developing roller that supplies developing agent onto the electrostatic latent image on an image supporting material, and the layer regulating blade that pressure contacts the developing roller and regulates a uniform layer thickness of the developing agent that is supplied to the developing roller are arranged, and the surface of the developing roller is made of brass, and the layer regulating blade is formed of stainless steel, and the pressing force of the layer regulating blade to the developing roller is 70–100[gf/cm].

8 Claims, 10 Drawing Sheets

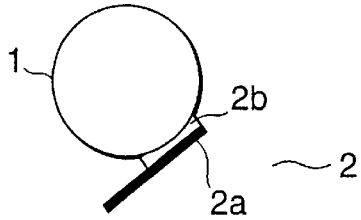

FIG. 1

LAYER FORMING CONDITION : INITIAL CASE,
LAYER REGULATING BLADE WITH A URETHANE
RUBBER LAYER (t=1,000μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | TONER SPILLING | TONER SPILLING | ○ | TORQUE LARGE |
| | 3≦a<4 | TONER SPILLING | TONER SPILLING | TONER SPILLING | TORQUE LARGE |
| | 4≦a<5 | TONER SPILLING | TONER SPILLING | TONER SPILLING | TORQUE LARGE |

FIG. 2

LAYER FORMING CONDITION : AFTER LIFE,
LAYER REGULATING BLADE WITH AN URETHANE
RUBBER LAYER (t=1,000μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | — | — | TONER ATTACHMENT | — |
| | 3≦a<4 | — | — | — | — |
| | 4≦a<5 | — | — | — | — |

FIG. 3

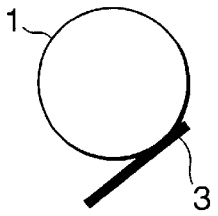

FIG. 4

LAYER FORMING CONDITION : INITIAL CASE,
LAYER REGULATING BLADE WITHOUT A COATING (t=0)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | ○ | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 5

LAYER FORMING CONDITION : AFTER LIFE,
LAYER REGULATING BLADE WITHOUT A COATING (t=0)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | DAMAGE | DAMAGE | — | — |
| | 3≦a<4 | — | — | DAMAGE | — |
| | 4≦a<5 | — | — | — | — |

FIG. 6

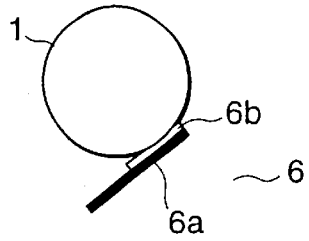

FIG. 7

LAYER FORMING CONDITION : INITIAL CASE,
LAYER REGULATING BLADE WITH AN URETHANE
RUBBER LAYER (t=30μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | ○ | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 8

LAYER FORMING CONDITION : AFTER LIFE,
LAYER REGULATING BLADE WITH AN URETHANE
RUBBER LAYER (t=30μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | ○ | ○ | — | — |
| | 3≦a<4 | — | — | DAMAGE | — |
| | 4≦a<5 | — | — | — | — |

FIG. 9

LAYER REGULATING BLADE WITH AN URETHANE RUBBER LAYER (t=50μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | ○ | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 10

LAYER FORMING CONDITION : AFTER LIFE, LAYER REGULATING BLADE WITH AN URETHANE RUBBER LAYER (t=50μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | ○ | ○ | — | — |
| | 3≦a<4 | — | — | ○ | — |
| | 4≦a<5 | — | — | — | — |

FIG. 11

LAYER FORMING CONDITION : INITIAL CASE, LAYER REGULATING BLADE WITH AN URETHANE RUBBER LAYER (t=100,200,300μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | ○ | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 12

LAYER FORMING CONDITION : AFTER LIFE,
LAYER REGULATING BLADE WITH AN URETHANE
RUBBER LAYER (t=100,200,300μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | ○ | ○ | — | — |
| | 3≦a<4 | — | — | ○ | — |
| | 4≦a<5 | — | — | — | — |

FIG. 13

LAYER FORMING CONDITION : INITIAL CASE,
LAYER REGULATING BLADE WITHOUT AN URETHANE
RUBBER LAYER (t=30μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | TONER SPILLING | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 14

LAYER FORMING CONDITION : AFTER LIFE,
LAYER REGULATING BLADE WITH AN URETHANE
RUBBER LAYER (t=30μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | — | ○ | — | — |
| | 3≦a<4 | — | — | DAMAGE | — |
| | 4≦a<5 | — | — | — | — |

FIG. 15

LAYER FORMING CONDITION : INITIAL CASE,
LAYER REGULATING BLADE WITHOUT AN URETHANE
RUBBER LAYER (t=50,100,200,300μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | TONER SPILLING | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 16

LAYER FORMING CONDITION : AFTER LIFE,
LAYER REGULATING BLADE WITH AN URETHANE
RUBBER LAYER (t=50,100,200,300μm THICKNESS)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | — | ○ | — | — |
| | 3≦a<4 | — | — | ○ | — |
| | 4≦a<5 | — | — | — | — |

FIG. 17

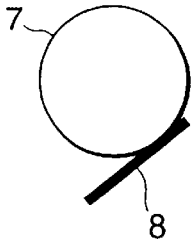

FIG. 18

LAYER FORMING CONDITION : INITIAL CASE,
LAYER REGULATING BLADE WITHOUT COATING (t=0)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | LAYER THICKNESS SHORTAGE | LAYER THICKNESS SHORTAGE | LAYER THICKNESS SHORTAGE | TORQUE LARGE |
| | 2≦a<3 | ○ | ○ | LAYER THICKNESS SHORTAGE | TORQUE LARGE |
| | 3≦a<4 | TONER SPILLING | TONER SPILLING | ○ | TORQUE LARGE |
| | 4≦a<5 | TONER SPILLING | TONER SPILLING | TONER SPILLING | TORQUE LARGE |

FIG. 19

LAYER FORMING CONDITION : AFTER LIFE,
LAYER REGULATING BLADE WITHOUT COATING (t=0)

| | | PRESSING FORCE OF THE LAYER REGULATING BLADE (gf/cm) | | | |
|---|---|---|---|---|---|
| | | 70 | 100 | 150 | 200 |
| DEVELOPING ROLLER SURFACE ROUGHNESS Rz a (μm) | 1≦a<2 | — | — | — | — |
| | 2≦a<3 | ○ | ○ | — | — |
| | 3≦a<4 | — | — | DAMAGE | — |
| | 4≦a<5 | — | — | — | — |

FIG. 20

DEVELOPING DEVICE WITH DEVELOPER LAYER REGULATING BLADE

BACKGROUND OF THE INVENTION

1. Field of the Invention

The present invention relates to a developing device that develops an electrostatic latent image by use of a nonmagnetic one-component developing agent in image forming devices such as an electrographic device, printer and so forth.

2. Description of the Related Art

Along with the spread of image forming devices such as electro photographic color printers, color multifunction peripherals (MFP) and so forth, used a developing device that develops an electrostatic latent image by use of toner as a non-magnetic one-component developing agent, since it enables to obtain high quality images without concentration control, and enables users to easily exchange developing devices and toners with excellent user maintenance properties, and further enables to make a simplified and compact and light weight device without necessity of magnetic materials.

So as to obtain preferable developed images by use of this non-magnetic one-component developing agent, it is required to charge toner preferably and to form a thin and uniform toner layer on a developing roller. For this reason, in the prior art, developing devices that press contact a layer regulating blade on a developing roller for forming a toner layer are disclosed in Japan Patent Disclosure (Kokai) No. 5-241432 and Japan Patent Disclosure (Kokai) No. 8-240987. However, in the developing rollers disclosed in the above, the surface of each developing roller is made of conductive rubber.

In such a developing device employing a developing roller made of conductive rubber, it is possible to attain preferable images in a color image forming device whose process speed is relatively low, for example 100 mm/s or so, on the other hand, when employed in a color image forming device whose process speed is over, for example 180 mm/s, space between a layer regulating blade and a developing roller will be made wider owing to pressure from a toner layer that is formed around the developing roller. Accordingly, it is not possible to sufficiently regulate a toner layer into a uniform and thin layer, as a result, toner will drop down from a developing device, which has been inconvenient.

On the other hand, also in the prior art, employed for these years is a full color image forming device wherein a photosensitive belt is used in the place of a photosensitive drum, and thereby an electrostatic latent image is formed on this photosensitive belt. In this type of image forming device, an electrostatic latent image that is formed on a photosensitive belt is temporarily transferred onto an intermediate transfer medium, and toners are placed thereon on the intermediate transfer medium to attain a full color image. And as a developing device for supplying toners to such a photosensitive belt, one whose developing roller surface is made of metal has been developed. This metallic developing roller, in comparison with a conductive rubber roller, can make narrow a nip width with a layer regulating blade, and also make sharp the pressure distribution of such a layer regulating blade to a developing roller, therefore, it is suitable for high speed operation.

Namely in more concrete manners, as shown in FIG. 1, a layer regulating blade 2 wherein an urethane rubber sheet 2*b* of thickness about 1 mm is adhered to a stainless steel plate spring 2*a,* is pressed onto a developing roller 1 whose surface is made of aluminum (Al), thereby a toner layer is formed even on the surface of the developing roller 1.

However, even though the surface of the developing roller 1 is made of metal, when a process speed is made higher, the regulation of toner layer by the layer regulating blade 2 to the developing roller 1 will become insufficient, causing toner spilling. On the other hand, if the pressing force of the layer regulating blade 2 to the developing roller 1 is strengthened so as to prevent toner spilling, the driving torque of the developing roller 1 will become large, causing toner to fix onto the developing roller 1 or the layer regulating blade 2, and leading to image failure.

Therefore, in order to be able to regulate a toner layer without increasing pressing force, by making a layer regulating blade as well as a developing roller into a metallic plate spring, making narrower the nip between the developing roller and layer regulating blade, we have tried making sharper the pressure distribution of layer regulating blade to developing roller. As a result, since a metallic developing roller and layer regulating blade directly contact each other, both of them are scratched, consequently, streak failures are made on images, therefore, we have not yet seen its practical application so far.

As a consequence, in a high speed image forming device, there is a demand for attaining preferred developed images, by forming a thin and uniform layer of toner as a non-magnetic one-component developing agent on a developing roller surface, without damaging both a developing roller and a layer regulating blade, and without deteriorating display quality by dirty images caused by dirt on peripherals by toner spilling or toner attachment onto a developing roller or a layer regulating blade.

SUMMARY OF THE INVENTION

Accordingly, the object of the present invention is to provide a developing device that may supply a thin and uniform layer of toner as a non-magnetic one-component developing agent to a developing roller, without deteriorating display quality owing to toner spilling over peripherals or toner attachment onto a developing roller or a layer regulating blade, and may be applied to a high speed image forming device.

It is another object of the present invention to provide a developing device that prevent a developing roller and/or a layer regulating blade from being damaged when toner as a non-magnetic one-component developing agent is applied thin and uniform onto the surface of developing roller, and may be applied to a high speed image forming device.

According to the present invention, there is provided a developing device comprising developing agent supplying means shaped a roller for supplying developing agent onto an electrostatic latent image on an image carrier; layer regulating means pressure contacting with the developing agent supplying means for regulating uniformly a layer thickness of the developing agent that is supplied to the developing agent supplying means; and an elastic resin coat layer coated on the surface of the layer regulating means, wherein the thickness t of the elastic resin is $10 \times a \leqq t \leqq 300$ [$\mu$m] when the surface of the developing agent supplying means is formed of a metallic material whose surface roughness Rz is a [$\mu$m], and the layer regulating means is made of a metallic material.

Further according to the present invention there is provided a developing device comprising a developing roller configured to supply developing agent onto an electrostatic latent image on an image carrier; a layer regulating blade pressure contacting with the developing roller to regulate uniformly a layer thickness of the developing agent that is supplied to the developing roller; and an elastic resin coat layer coated on the surface of the layer regulating blade, wherein the thickness t of the elastic resin is $10\times a \leqq t < 300$ [μm] when the surface of the developing roller is formed of a metallic material whose surface roughness Rz is a [μm], and the layer regulating blade is made of a metallic material.

Still further, according to the present invention, there is provided a developing device comprising a developing roller configured to supply developing agent onto an electrostatic latent image on an image carrier; and a layer regulating blade pressure contacting with the developing roller to regulate uniformly a layer thickness of the developing agent that is supplied to the developing roller; wherein the surface of the developing roller is made of brass, and the layer regulating blade is formed of stainless steel, and the pressing force of the layer regulating blade to the developing roller is 70–100[gf/cm].

BRIEF DESCRIPTION OF THE DRAWINGS

FIG. 1 is a schematic diagram showing a conventional developing roller and a layer regulating blade;

FIG. 2 is a table showing test results on initial case using the layer regulating blade shown in FIG. 1;

FIG. 3 is a table showing test results after life using the layer regulating blade shown in FIG. 1;

FIG. 4 is an explanatory diagram showing a metallic developing roller and a layer regulating blade made solely of metal;

FIG. 5 is a table showing test results on initial case using the layer regulating blade shown in FIG. 4;

FIG. 6 is a table showing test results after life using the layer regulating blade shown in FIG. 4;

FIG. 7 is an explanatory diagram showing a metallic developing roller and a layer regulating blade which is coated by an urethane rubber layer;

FIG. 8 is a table showing test results on initial case using a layer regulating blade wherein the circumferencial speed of a developing roller in FIG. 7 is 250 [mm/s], and the thickness of an urethane rubber layer is 30 [μm];

FIG. 9 is a table showing test results after life using a layer regulating blade wherein the circumferencial speed of a developing roller in FIG. 7 is 250 [mm/s], and the thickness of an urethane rubber layer is 30 [μm];

FIG. 10 is a table showing test results on initial case using a layer regulating blade wherein the circumferencial speed of a developing roller in FIG. 7 is 250 [mm/s], and the thickness of an urethane rubber layer is 50 [μm];

FIG. 11 is a table showing test results after life using a layer regulating blade wherein the circumferencial speed of a developing roller in FIG. 7 is 250 [mm/s], and the thickness of an urethane rubber layer is 50 [μm];

FIG. 12 is a table showing test results on initial case using a layer regulating blade wherein the circumferencial speed of a developing roller in FIG. 7 is 250 [mm/s], and each thickness of urethane rubber layers is 100, 200, and 300 [μm];

FIG. 13 is a table showing test results after life using a layer regulating blade wherein the circumferencial speed of a developing roller in FIG. 7 is 250 [mm/s], and each thickness of urethane rubber layers is 100, 200, and 300 [μm];

FIG. 14 is a table showing test results on initial case using a layer regulating blade wherein the circumferencial speed of a developing roller in FIG. 7 is 400 [mm/s], and the thickness of an urethane rubber layer is 30 [μm];

FIG. 15 is a table showing test results after life using a layer regulating blade wherein the circumferencial speed of a developing roller in FIG. 7 is 400 [mm/s], and the thickness of an urethane rubber layer is 30 [μm];

FIG. 16 is a table showing test results on initial case using a layer regulating blade wherein the circumferencial speed of a developing roller in FIG. 7 is 400 [mm/s], and each thickness of urethane rubber layers is 50, 100, 200, and 300 [μm];

FIG. 17 is a table showing test results after life using a layer regulating blade wherein the circumferencial speed of a developing roller in FIG. 7 is 400 [mm/s], and each thickness of urethane rubber layers is 50, 100, 200, and 300 [μ];

FIG. 18 is a schematic diagram showing a brass developing roller and a layer regulating blade made solely of stainless steel;

FIG. 19 is a table showing test results on initial case sing the layer regulating blade shown in FIG. 18;

FIG. 20 is a table showing test results after life using the layer regulating blade shown in FIG. 18;

DETAILED DESCRIPTION OF THE PREFERRED EMBODIMENTS

Figure 21:
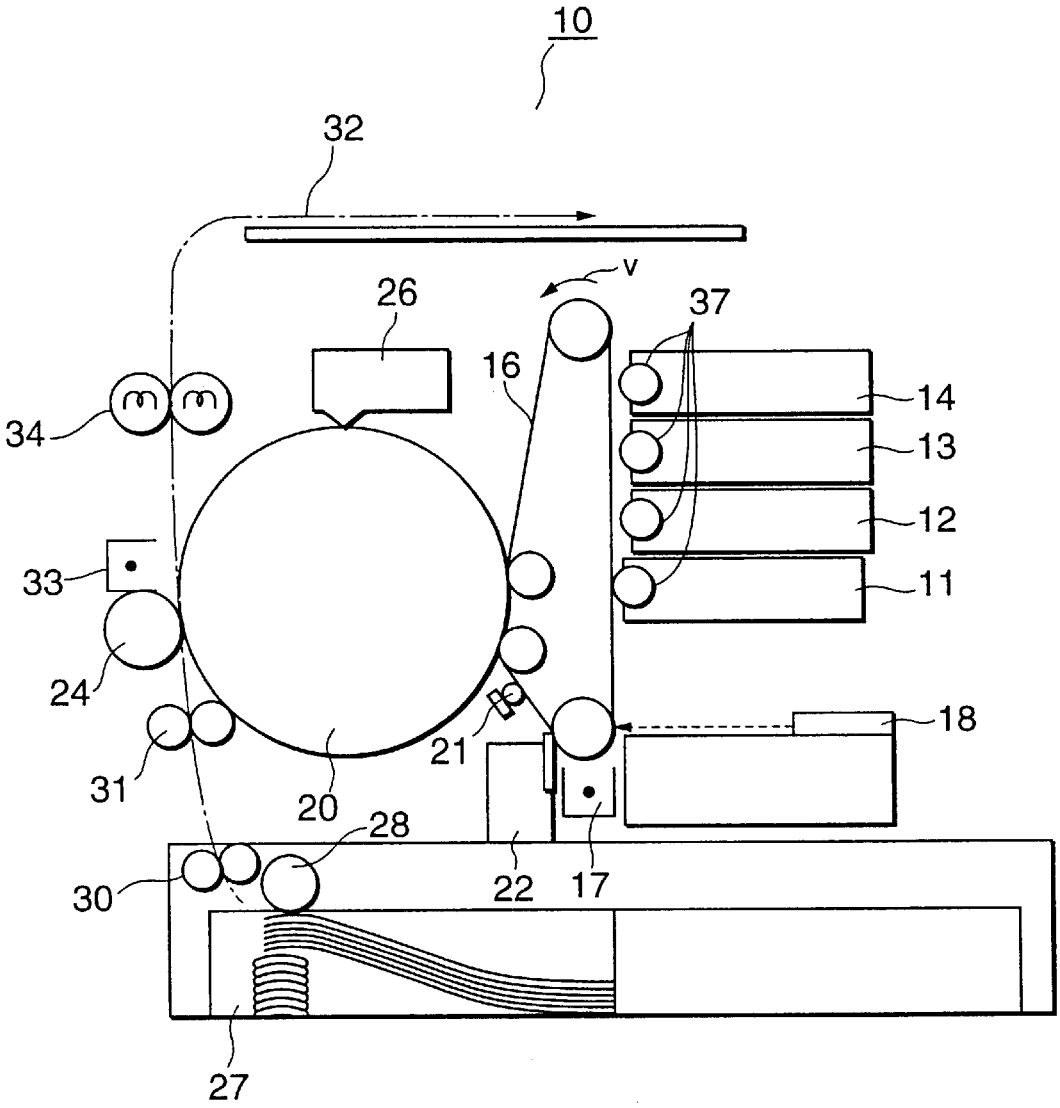
FIG. 21 is a structural diagram schematically showing an image forming portion of a full color printer as a first preferred embodiment according to the present invention.
Figure 22:
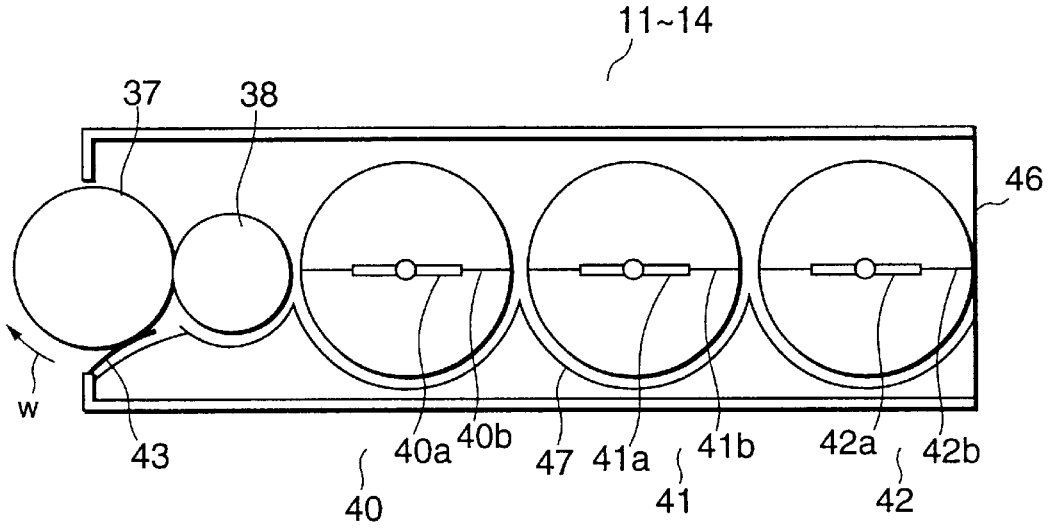
FIG. 22 is a structural diagram schematically showing a developing device as a first preferred embodiment according to the present invention.
Figure 23:
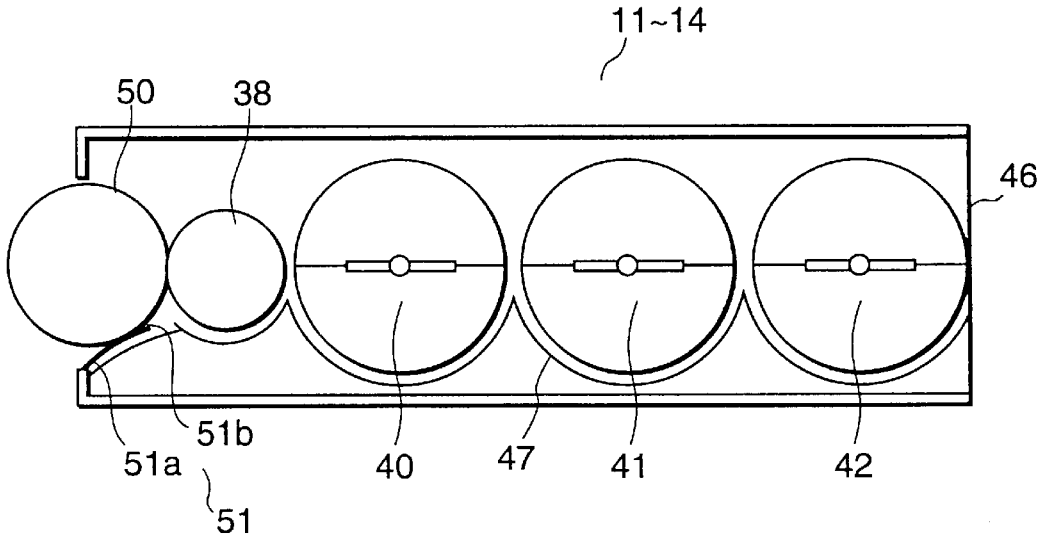
FIG. 23 is a structural diagram schematically showing a developing device as a second preferred embodiment according to the present invention.
Figure 24:
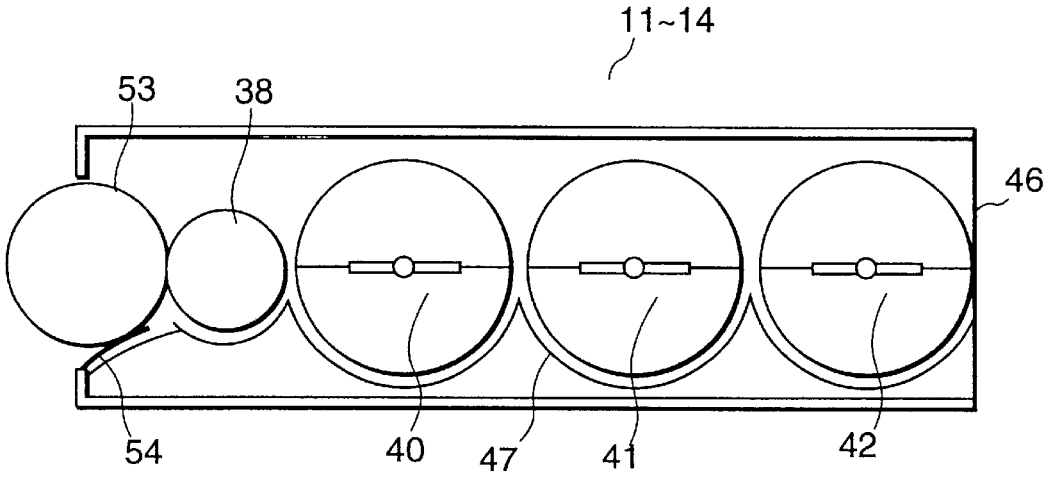
FIG. 24 is a structural diagram schematically showing a developing device as a third preferred embodiment according to the present invention.

The invention is illustrated in more details by reference to the following referential examples and preferred embodiments wherein.

In the first place, by changing the surface roughness degrees of a metallic developing roller, and the thickness values of urethane rubber layer of a metallic layer regulating blade, we conducted evaluation tests on presence or absence of toner spilling, good or bad of toner layer thickness, and presence or absence of toner attachment. By the way, our experiences tell that there is a certain correlation between toner layer thickness and image concentration, when toner layer thickness is fixed and the circumferential speed ratio of developing roller and photosensitive material is fixed, in these tests, the circumferencial speed ratio of developing roller to photosensitive material speed as a process speed was set 1.5, and in reality the circumferencial speed of developing roller was set 250 [mm/s], and layer thickness was set 450 [$\mu g/cm^2$], then a desired image concentration of 1.5 or more was attained, therefore, we judged that toner layer thickness of 450 [$g/cm^2$] or more was preferable.

And the evaluation was conducted at 2 points at the initial case and after life (after continuous printing 15,000 sheets by use of an actual printer). First, when the roughness of developing roller was set a [μm], 4 levels, $1 \leqq a < 2$ [μm], $2 \leqq a < 3$ [μm], $3 \leqq a < 4$ [μm], and $4 \leqq a < 5$ [μm] are made, and urethane rubber layer thickness was set 1000 [μm], thickness of only metallic plate spring was set 0 [μm], 30 [μm], 50 [μm], 100 [μm], 200 [μm], and 300 [μm]; and the pressing force of layer regulating blade to developing roller was set 70 [gf/cm], 100 [gf/cm], 150 [gf/cm], and 200 [gf/cm]. Tests for initial case were carried out with all the conditions, while life tests were conducted only with those conditions under which layer was formed preferably in the initial case.

In the first place, the result of the case, wherein by using a layer regulating blade 2 in which an urethane rubber sheet 2*b* of thickness about 1,000 [μm] is adhered onto the end of a stainless steel plate spring 2*a* as shown in FIG. 1, a toner layer is formed on a developing roller 1 made of aluminum, are shown in the table in FIG. 2 and that in FIG. 3. With a developing roller whose surface roughness a is $1 \leqq a < 2$[μm], preferred toner layer thickness cannot be attained irrespective of the size of pressing force of the layer regulating blade 2, and shortage in layer thickness causes image failure.

On the other hand, with a developing roller whose surface roughness a is over 2 [μm], preferred images can be attained without layer thickness shortage or toner spilling, only when the surface roughness a is $2 \leqq a < 3$ [μm] and the pressing force is 150 [gf/cm], but under other conditions, the space between the developing roller 1 and the layer regulating blade 2 is made wider, and toner will spill therefrom. However, when the surface roughness a of the developing roller 1 is $2 \leqq a < 3$ [μm] and the pressing force is 150 [gf/cm], after life after continuously printing 15,000 sheets, since the pressing force of the layer regulating blade 2 is strengthened, toner attaches onto the layer regulating blade 2, causing image failure in form of streaks, leading to deteriorated display quality.

In the next place, the result of the case, wherein by using a layer regulating blade 3 made solely of a steinless steel plate spring whose urethane rubber sheet thickness is 0[μ] as shown in FIG. 4, a toner layer is formed on a developing roller 1 made of aluminum, are shown in the table in FIG. 5 and that in FIG. 6. With a developing roller whose surface roughness a is $1 \leqq a < 2$[μm], preferred toner layer thickness cannot be attained irrespective of the size of pressing force of the layer regulating blade 3, and shortage in layer thickness causes image failure.

On the other hand, with a developing roller whose surface roughness a is $2 \leqq a < 3$ [μm], preferred images can be attained without layer thickness shortage or toner spilling, when the pressing force of the layer regulating blade 3 is 70–100 [gf/cm]. And also when the surface roughness a of the developing roller 1 is $3 \leqq a < 4$[pm] and the pressing force of the layer regulating blade 3 is 150 [gf/cm], preferred images can be obtained. It is considered this is because pressure distribution varies with the pressing force that layer regulating blade works via urethane rubber layer of thickness 1000 [μm] onto the developing roller and the pressing force that works from the metallic plate directly onto the developing roller, and only the metallic plate has a sharp pressure distribution, as a result layer can be regulated by low pressing force. Nevertheless, after life after continuously printing 15,000 sheets, in each case, streaks occur on the developing roller 1 and the layer regulating blade 3, causing them unusable. It is considered this is because metals contact directly each other, both the developing roller 1 and the layer regulating blade 3 are apt to be damaged.

In consideration of the above results, by use of a layer regulating blade 6 where urethane rubber 6*b* is formed in layers of thickness degrees, 30 [μm], 50 [μm], 100 [μm], 200 [μm], and 300 [μm] onto the end of a stainless steel plate spring 6*a,* a toner image was formed on the aluminum developing roller 1, and the results shown in FIG. 8 through FIG. 13 were obtained.

Firstly, in the case where the layer thickness of urethane rubber 6*b* is 30 [μm], as shown in the table in FIG. 8 and that in FIG. 9, with developing roller whose surface roughness a is $1 \leqq a < 2$ [μm], preferred toner layer thickness cannot be attained irrespective of the size of pressing force of the layer regulating blade 2, and shortage in layer thickness causes image failure.

On the other hand, with a developing roller whose surface roughness a is $2 \leqq a < 3$ [μm], preferred images can be attained without layer thickness shortage or toner spilling, even when the pressing force of the layer regulating blade 6 is 70–100 [gf/cm]. And also when the surface roughness a of the developing roller 1 is $3 \leqq a < 4$ [μm] and the pressing force of the layer regulating blade 6 is 150 [gf/cm], preferred images can be obtained. However, after life, in the case where the surface roughness a of the developing roller is $3 \leqq a < 4$ [μm] and the pressing force of the layer regulating blade 6 is 150 [gf/cm], the developing roller 1 and the layer regulating blade 6 showed damages in streaks, and became unusable.

In the next place, in the case where the layer thickness of urethane rubber 6*b* is 50 [μm], as shown in the table in FIG. 10 and that in FIG. 11, in the initial case, the results showed same as in the vase with the layer thickness 30 [μm] of the above urethane rubber 6*b,* but after life, even when the surface roughness a of the developing roller was $3 \leqq a < 4$ [μm] and the pressing force of the layer regulating blade 6 was 150 [gf/cm], the developing roller 1 and the layer regulating blade 6 had not damage.

Further, in cases where the layer thickness of urethane rubber 6*b* was 100 [μm], 200 [μm] and 300 [μm], as shown in the table in FIG. 12 and that in FIG. 13, as same as the above mention case with layer thichness 50 [μm] of urethane rubber 6*b,* both in the initial case and after life, there was no layer thickness shortage or toner spilling, and further no demage was to seen in both the developing roller 1 and the layer regulating blade 6.

From the test results mentioned above, it has been known that so as to obtain preferred images from the initial case though after life, when the developing roller roughness Rz is designated as a [μm], the layer thickness of urethane rubber formed on the surface of layer regulating blade is designated as t [μm], then the layer thickness t [μm] should be at least $10 \times a \leqq t < 300$ [μm].

In the next place, the circumferencial speed of developing roller was made further higher to 400 [μm] by use of a layer regulating blade 6 where urethane rubber 6*b* is formed in layers of thickness degrees, 30 [μm], 50 [μm], 100 [μm], 200 [μm], and 300 [μm] onto the end of a stainless steel plate spring 6*a,* a toner image was formed on the aluminum developing roller 1, tests were conducted on evaluation about presence or absence of toner spilling, good or bad of toner layer thickness, and presence or absence of toner attachment, and through these tests, the results shown in FIG. 14 through FIG. 17 were obtained.

Firstly, in the case where the layer thickness of urethane rubber 6*b* is 30 [μm], as shown in the table in FIG. 14 and that in FIG. 15, with developing roller whose surface roughness a is $1 \leqq a < 2$ [μm], preferred toner layer thickness cannot be attained irrespective of the size of pressing force of the layer regulating blade 2, and shortage in layer thickness causes image failure.

In the meantime, with a developing roller whose surface roughness a is $2 \leqq a < 3$ [μm], preferred images can be attained without layer thickness shortage or toner spilling, even when the pressing force of the layer regulating blade 6 is 100 [gf/cm]. And also when the surface roughness a of the developing roller 1 is 3≦a<4 [μm] and the pressing force of the layer regulating blade 6 is 150 [gf/cm], preferred images can be obtained too. However, after life, in the case where the surface roughness a of the developing roller is 3≦a<4 [μm] and the pressing force of the layer regulating blade 6 is 150 [gf/cm], the developing roller 1 and the layer regulating blade 6 showed damages in streaks, and became unusable.

Then, in the case where the layer thickness degrees of urethane rubber 6*b* were 50 [μm], 100 [μm], 200 [μm] and 300 [μm], as shown in the table in FIG. 16 and that in FIG. 17, in the initial case, the results showed same as in the vase with the layer thickness 30 [μm] of the above urethane rubber 6*b*, however after life, even when the surface roughness a of the developing roller was 3≦a<4 [μm] and the pressing force of the layer regulating blade 6 was 150 [gf/cm], the developing roller 1 and the layer regulating blade 6 were free of damage.

From the test results mentioned above, it has been known that even when the circumferencial speed of developing roller is made further higher up to 400 [μm], in order to obtain preferred images from the initial case though after life just same as in the case with circumferencial speed 250 [μm], if the developing roller roughness Rz is designated as a [μm], the layer thickness of urethane rubber formed on the surface of layer regulating blade is designated as t [μm], then the layer thickness t [μm] should be at least 10×a≦t<300 [μm].

After these tests, the circumferencial speed of developing roller was made further higher, and similar evaluation tests were conducted, as a result, it has been found that so far as within the range of circumferencial speed 250–400 [mm/s], if the developing roller roughness Rz is designated as a [μm], the layer thickness of urethane rubber formed on the surface of layer regulating blade is designated as t [μm], then if the layer thickness t [μm] should be at least 10×a≦t<300 [μm], then preferred images may be attained without toner spilling or toner attachment.

In the further next place, as shown in FIG 18, the raw material of the developing roller 7 was changed from aluminum to brass, and by use of a layer regulating blade 8 made of solely stainless steel plate spring with urethane layer thickness 0 [μm], a toner layer was formed on a brass developing roller 7, and the results thereof are shown in the table in FIG. 19 and that in FIG. 20. With a developing roller 7 whose surface roughness a is 1≦a<2 [μm], preferred toner layer thickness cannot be attained irrespective of the size of pressing force of the layer regulating blade 8, and shortage in layer thickness causes image failure.

Incidentally, with a developing roller 7 whose surface roughness a is 2≦a<3 [μm], preferred images can be attained without layer thickness shortage or tone spilling, even when the pressing force of the layer regulating blade 8 is 70–100 [gf/cm]. And also when the surface roughness a of the developing roller 7 is 3≦a<4 [μm] and the pressing force is 150 [gf/cm], preferred images can be obtained. And further, in the case with surface roughness 2≦a<3 [μm] and pressing force 70–100 [gf/cm], even after life after continously printing 15,000 sheets, there is hardly damage on the developing roller 7 and the layer regulating blade 8, and preferred image development can be done. However, in the case where the surface roughness a of the developing roller is 3≦a<4 [μm] and the pressing force of the layer regulating blade is 150 [gf/cm], the developing roller 7 and the layer regulating blade 8 showed damages in streaks, and becam unsable.

From the test results mentioned above, it has been found that it is possible to attain preferable image development from initial case to after life, by make the developing roller 7 of brass with high hardness, and setting the pressing force of the layer regulating blade 8 at 70–100 [gf/cm].

On the basis of the test results mentioned above, a first preferred embodiment according to the present invention is described hereinafter in detail in connection with the accompanying drawings. FIG. 21 is a schematic structural diagram showing an image forming portion 10 of an intermediate transfer type full color printer, which has a black developing device 11, cyan developing device 12, magenta developing device 13 and yellow developing device 14 that respectively carry out development by use of each toner, black (BK), cyan (C), magenta (M) and yellow (Y).

Arranged around a photosensitive belt 16 of the image forming portion 10 are a charge device 17, an exposure device 18, a black developing device 11, a cyan developing device 12, a magenta developing device 13 and a yellow developing device 14 in this order. Further at the transfer position of the photosensitive belt 16 as an image carrier, an intermediate transfer material 20 is contacted holding a nip width, and at the downstream side of the transfer position, arranged are a discharge device 21 and a photosensitive material cleaner 22. The photosensitive belt 16, wherein a photosensitive material layer is formed on a base on which metal such as aluminum or so is deposited onto a resin film, or on a nickel electroformed base or so, is rotated at circumferencial speed 180 mm/s.

Around the intermediate transfer material 20, arranged is a transfer roller 24 that transfers a toner image transferred onto the intermediate transfer material 20 to a paper sheet P, and at the downstream side of the transfer roller 24, arranged is an intermediate transfer material cleaner 26 that cleans off remaining toner after transfer. Further under the photosensitive belt 16 and the intermediate transfer material 20, respectively arranged are a paper feed cassette device 27 that contains paper sheet P, a pickup roller 28 that takes out paper sheet P from the paper feed cassette device 27, a feed roller that separates and transfers paper sheet P taken from the paper feed cassette device 27, and a resist roller 31 that supplies paper sheet P to the transfer roller 24 at certain timing. While, at the downstream side of the transfer roller 24, arranged are a separation charger 33 along a paper path 32 and a fixing device 34, and further a paper discharge tray 36.

Now described hereafter is the developing device. The black developing device 11, the cyan developing device 12, the magenta developing device 13 and the yellow developing device 14 respectively develop imaged by use of respective non-magnetic mono-element developing agents, i.e., black (BX), cyan (C), magenta (M) and yellow (Y), and each of them has an identical structure. Each of the developing devices 11~14 comprises a developing roller 37 that supplies toner to the photosensitive belt 16, a toner supply roller 38 that supplies toner to the developing roller 37, and transfer blades 40, 41 and 42 that transfer toner from back side to the toner supply roller 38. Onto the surface of developing roller 37, pressed and contacted is the layer regulating blade 43 that regulates the layer thickness of toner supplied from the toner supply roller 38.

The surface of the developing device 37 is made of metal, and for example, a bar or tube of aluminum, brass stainless steel or so is suitable for it. Herein an aluminum tube is employed. The surface of the developing roller 37 is sand blasted so as to attain a desired surface roughness Rz thereon. When a desired surface roughness Rz is designated as a [μm], a should be 2–3 [μm]. The external diameter of the developing roller 37 is about ϕ18, the and circumferencial speed thereof is set 250 mm/s.

The toner supply roller 38 is made of foaming urethane with external diameter about ϕ13.5, and the resistance value thereof has a conductive property around $10^3$ [Ω]. The layer regulating blade 43 has an elastic resin coat layer 43*b* of thickness about 100 [μm], on the surface of the end of the stainless steel plate spring 43*a* thereof. The layer thickness of this elastic resin coat layer 43*b* well meets the condition of layer thickness t [μm] to attain preferred image development, $10 \times a \leqq t < 300$ [μm] , when the surface roughness of the developing roller is designated as a [μm].

With respect to elastic resin, urethane, silicon rubber and so forth are suitable for the purpose, while as for coating method, elastic resin solved in solvent may be sprayed into a uniform thickness by use of a general spray method, or it may be applied into a uniform thickness by use of dipping method. The pressing force of the layer regulating blade 43 to the developing roller 37 should be 95 [gf/cm].

The transfer blades 40, 41 and 42 have a structure herein Mylar sheets 40*b,* 41*b* and 42*b* are attached to 2 points (at 180 degrees to each other) around the shaft 40*a,* 41*a* and 42*a,* and the Mylar sheets 40*b,* 41*b* and 42*b* rub against a curved surface 47 of the bottom of a developing container 46 so as to transfer toner in the developing container 46 toward the toner supply roller 38.

In the next place, actions are described hereinafter. When a print operation starts, the image forming portion 10 repeats a toner image forming process for the respective colors in accordance with image data input from a scanner portion not illustrated herein, and thereby forms a color piled toner image on the intermediate transfer material 20.

Namely, in the case when image data is of a full color image, first in accordance with the rotation of the photosensitive belt 16 that is rotated at 180 mm/s in the arrow v direction, toner image forming processes are carried out one after another. The photosensitive belt 16 is evenly charged by the charge device 17. Then exposure action is carried out onto this evenly charged photosensitive belt 16 by the exposure device 18, and an electrostatic latent image to correspond to the image data of yellow (Y) is formed on the photosensitive belt 16.

After then, the photosensitive belt 16 is developed by the yellow developing device 14, and a toner of yellow (Y) is formed on the photosensitive belt 16. At the moment of this development, in the yellow developing device 14, the respective transfer blades 40, 41 and 42 and the toner supply roller 38 are rotated, and at the same time, the developing roller 37 is rotated at circumferencial speed 250 mm/s in the arrow w direction. And by the pressing force of the layer regulating blade 43, a uniform toner layer of 540 [$\mu g/cm^2$] is formed on the surface of the developing roller 37, and by this toner layer, the electrostatic latent image is developed. After development, the photosensitive belt 16 reaches at the transfer position, and transfers the toner image of yellow (Y) to the intermediate transfer material 20. After transfer, the photosensitive belt 16 is light discharged by the discharge device 21, and then cleaned by the photosensitive material cleaner 22.

In the next, the photosensitive belt 16 is once again charged by the charge device 17, and the electrostatic latent image to correspond to the image data of magenta (M) is formed thereon, and in the same way as in the abovementioned yellow developing device 14, the electrostatic latent image on the photosensitive belt 16 is developed by the magenta developing device 13, and the toner image of magenta (M) is formed on the photosensitive belt 16. After then, the photosensitive belt 16 transfers the toner image of magenta (M) further onto the intermediate transfer material 20 that already has the yellow (Y) toner image. In the same manners, toner images of cyan (C) and black (BK) are transferred one by one onto the intermediate transfer material 20 that already has yellow (Y) and magenta (M) toner images, and thereby a full color toner image is formed on the intermediate transfer material 20.

On the other hand, in synchronization with the completion of the full color toner image on the intermediate transfer material 20, a paper sheet P is fed from the paper feed cassette device 27 by the pickup roller 28. The end of this paper sheet P is adjusted by the resist roller 31, and supplied to between the intermediate transfer material 20 and the transfer roller 24, where the full color toner image on the intermediate transfer material 20 is secondly transferred onto the paper sheet.

After then, the paper sheet P on which the full color toner image has been transferred is separated from the intermediate transfer material 20 by the separation charger 33, and the full color toner image is permanently fixed onto the paper sheet by the fixing device 34, and then the paper sheet P is discharged to the paper discharge tray 36. On the other hand, after separation of the paper sheet P, the intermediate transfer material 20 is cleaned of remaining toner and paper powder by the intermediate transfer material cleaner 26, for preparation for the next toner image transfer.

During the above processes, in the developing devices 11 to 14, preferred developed images having sufficient image concentration have been attained without toner spilling. And in the image forming portion 10, after life after continuous printing test on 15,000 sheets by use of, for example, the black developing device 11, the toner layer thickness formed on the surface of the developing roller 37 went down to 480 [$\mu g/cm^2$], however even with this thickness, the desired image concentration over 1.5 was well attained, and there could not be seen large damage or toner attachment on the layer regulating blade 43 and the developing roller 37, and even after life, preferable image development could be maintained.

In this manner, when the surface roughness a of the developing roller is set 2–3 [μm], so as to meet the layer thickness condition to attain preferred development $10 \times a \leqq t < 300$ [μm] from the initial case to after life, by coating a thin elastic resin coat layer 43*b* whose layer thickness t is 100 [μm] onto the surface of the layer regulating blade 43, it is possible to make sharper the pressure distribution of the layer regulating blade 43 that presses the developing roller 37 in comparison with the case to attach the conventional urethane rubber sheet.

Accordingly, it is possible to attain preferred developed images without toner spilling even without increasing the pressing force of the layer regulating blade 43, and it is possible to maintain preferable display quality without image damages in streaks owing to toner attachment onto developing roller or layer regulating blade that occurred owing to increased torque in the prior art. And moreover, the developing roller 37 and the layer regulating blade 43 are slidably contacted via the elastic resin coat layer, therefore, there is no fear of damage on the both even after life, and it is possible to realize a preferred developing device.

In the next section, a second preferred embodiment according to the present invention is described hereafter. In this second preferred embodiment, the process speed of the image forming portion 10 is further made higher to 280 mm/s than the first preferred embodiment, and to cope with this higher process speed, the circumferencial speed of the developing roller 37 in the respective developing devices 11 through 14 are made higher accordingly. Therefore, in this second preferred embodiment, identical codes are applied to identical components to those in the first preferred embodiment, and detailed explanations thereof are omitted herein.

From the results of evaluation tests on presence or absence of toner spilling, good or bad of toner layer thickness, and presence or absence of toner attachment by changing the surface roughness a [$\mu$] of a metallic developing roller, and the thickness t [$\mu$m] of urethane rubber layer of a metallic layer regulating blade mentioned before, it has been found that it is possible to obtain preferred development from the initial case to after life, even if the developing roller circumferencial speed gets as high as 400 mm/s, so far as the thickness is with in the range $10\times a \leqq t < 300$ [$\mu$m].

As a consequence, in this preferred embodiment, along with the fact that the circumferencial speed of the photosensitive material roller 16 in the first preferred embodiment is made higher up to 280 mm/s, the surface roughness a [$\mu$m] of the aluminum tube of the developing roller 50 to be used in the developing devices 11–14 is set a=2–3 [$\mu$m], while the circumferencial speed is made higher to 400 mm/s. Beside these modifications, the layer thickness of the elastic resin coat layer 51*b* to be coated on the end surface of the stainless steel plate spring 51*a* of the layer regulating blade 51 is set to about 30 [$\mu$m].

The layer thickness of this elastic resin coat layer 51*b* well meets the condition of layer thickness t [$\mu$m] to attain preferred image development, $10\times a \leqq t < 300$ [$\mu$m], when the surface roughness of the developing roller is designated as a [$\mu$m].

In the developing devices 11 to 14 having the above mentioned developing roller 50 and the layer regulating blade 51, at development, the developing roller 50 is rotated at circumferencial speed 400 mm/s in the arrow w direction, and by the pressing force of the layer regulating blade 51, a uniform toner, layer of 520 [$\mu g/cm^2$] is formed on the surface of the developing roller 50, and an electrostatic latent image formed on the photosensitive belt 16 by this toner image is developed in preferable manners.

And in the image forming portion 10, after life after continuous printing test of 15,000 sheets by use of, for example, the black developing device 11, the toner layer thickness formed on the surface of the developing roller 37 went down to 450 [$\mu g/cm^2$], however, even with this thickness, the desired image concentration was well attained, and there could not be seen large damage or toner attachment on the layer regulating blade 51 and the developing roller 50, and even after life test, preferable image development could be maintained. During the test, the developing devices 11 to 14 saw no toner spilling at all.

In this manner, when the surface roughness a of the developing roller is set 2–3 [$\mu$m], so as to meet the layer thickness condition to attain preferred development $10\times a \leqq t < 300$ [$\mu$m] from the initial case to after life, by coating an elastic resin coat layer 51*b* whose layer thickness t is 30 [$\mu$m] onto the surface of the layer regulating blade 51, it is possible to attain preferable developed images without toner spilling and without increasing the pressing force, in spite of the further higher speed of the developing roller 50, and maintain preferred display quality without image damages in streaks owing to toner attachment onto developing roller or layer regulating blade that occurred owing to increased torque in the prior art. And there is no fear of damage on the developing roller 50 and the layer regulating blade 51 even after life, and it is possible to realize a preferred developing device.

In the next place, a third preferred embodiment according to the present invention is described hereafter. In this third preferred embodiment, the aluminum developing roller 37 of the developing devices 11 through 14 used in the first preferred embodiment is replaced with a brass developing roller, and further the layer regulating blade 43 having the elastic resin coat layer 43*b* is changed into one made solely stainless steel. Therefore, in this third preferred embodiment, identical codes are applied to identical components to those in the first preferred embodiment, and detailed explanations thereof are omitted herein.

From the results of evaluation tests on presence or absence of toner spilling, good or bad of toner layer thickness, and presence or absence of toner attachment by changing the surface roughness a [$\mu$m] of a metallic developing roller, and the thickness t [$\mu$m] of urethane rubber layer of a metallic layer regulating blade mentioned before, it has been found that it is possible to obtain preferred development from the initial case to after life, so far as the developing roller is made of brass, and the pressing force of the layer regulating blade is 70–100 [gf/cm].

Accordingly, in this preferred embodiment, a brass tube is employed as the developing roller 53 to be used in the developing devices 11 to 14 in the first preferred embodiment, and the surface roughness a [$\mu$m] thereof is set a=2–3 [$\mu$m]. And at the same time, the layer regulating blade 54 is made of solely a stainless steel plate spring.

In the developing devices 11 to 14 having the above mentioned developing roller 53 and the layer regulating blade 54, at development, the developing roller 53 is rotated at circumferencial speed 250 mm/s in the arrow t direction, and by the pressing force of the layer regulating blade 54, a uniform toner layer of 540 [$\mu g/cm^2$] is formed on the surface of the developing roller 53, and an electrostatic latent image formed on the photosensitive belt 16 by this toner image is developed in preferable manners.

And in the image forming portion 10, after life after continuous printing test of 15,000 sheets by use of, for example, the black developing device 11, there could not be seen damage on the developing roller 53 and the layer regulating blade 54, and there was no fear of adverse effect upon developed images, and preferred development images could be attained without image failure owing to damages. And after life, the toner layer thickness formed on the surface of the developing roller 53 went down to 520 [$\mu g/cm^2$], however, even with this thickness, the desired image concentration was well attained, and there could not be seen toner attachment onto the layer regulating blade 54 or the developing device 53, and even after life test, preferable image development could be maintained. During the above test, the developing devices 11 to 14 saw no toner spilling at all.

In this manner, by making the developing roller 53 solely of brass, and making the pressing force of the layer regulating blade 54 made solely of a stainless steel metallic spring 70–100 [gf/cm], it is possible to attain preferable developed images without toner spilling and without increasing the pressing force, in spite of the further higher speed of the developing roller 50, and maintain preferred display quality without image damage onto both the developing roller 53 and the layer regulating blade 54, as a result, it is possible to realize a preferred developing device.

As this invention may be embodied in several forms without departing from the sprit of essential characteristics thereof, for example, the raw material of a developing roller may be stainless steel or so forth, so far as it can form a non-magnetic one-component toner layer in uniform manner, and the surface roughness thereof may be optional. And the circumferencial speed of a developing roller is not limited to one mentioned in the above preferred embodiments, so far as it is in the range from 250 to 400 [mm/s]. Further, the raw material and forming method of an elastic resin coat layer to be formed on a layer regulating blade are not limited to ones mentioned in the above preferred embodiments, so far as a desired uniform thickness can be obtained. And a developing device according to the present invention may be applicable to image forming devices, copiers, MFP's and so forth optional.

As mentioned heretofore, according to the present invention, when the surface roughness Rz of a metallic developing roller is set a [$\mu$m], by coating a thin elastic resin coat layer whose layer thickness is t [$\mu$m] onto the surface of a metallic layer regulating blade in the range $10\times a \leqq t < 300$ [$\mu$m], it is possible to make sharper the pressure distribution of the layer regulating blade that presses a developing roller, as a result, it is possible to attain preferable developed images without toner spilling and without increasing the pressing force, in spite of the high speed of a developing device employing a non-magnetic one-component toner. Accordingly it is possible to maintain preferred display quality without image damages in streaks owing to toner attachment onto developing roller or layer regulating blade that occurred owing to increased torque in the prior art. And further, after life, there is no fear of damage on both a developing roller and layer regulating blade, therefore it is possible to realize a preferred developing device.

Moreover, by making a developing roller solely of brass, and making the pressing force of a stainless steel layer regulating blade 70–100 [gf/cm], it is possible to make sharper the pressure distribution by a layer regulating blade, even without applying an elastic resin coat layer on a layer regulating blade surface, without fear of damage on both a developing roller and a layer regulating blade, as a result it is possible to attain preferable developed images without toner spilling or image damage owing to toner attachment in and without increasing the pressing force, in spite of the higher speed of a developing roller, from the initial case to after life, as a result, it is possible to realize a preferred developing device.

What is claimed is:

1. A developing device comprising:

developing agent supplying means shaped as a roller for supplying developing agent onto an electrostatic latent image on an image carrier; the developing agent supplying means being set so that the circumferential speed s thereof has a range $250 \leqq s \leqq 400$ [mm/s];

layer regulating means pressure contacting with the developing agent supplying means by the pressing force of 70–100 [gf/cm] for regulating uniformly a layer thickness of the developing agent that is supplied to the developing agent supplying means; and an elastic resin coat layer coated on the surface of the layer regulating means, wherein the thickness t of the elastic resin is $10\times a \leqq t \leqq 50$ [$\mu$m] when the surface of the developing agent supplying means is formed of a metallic material whose surface roughness Rz is a [$\mu$m], and the layer regulating means is made of a metallic material.

2. A developing device according to claim 1, wherein the surface of the developing agent supplying means is made of aluminum, brass, or stainless steel.

3. A developing device according to claim 1, wherein the elastic resin coat layer is an urethane rubber or silicon rubber coat layer.

4. A developing device comprising:

a developing roller configured to supply developing agent onto an electrostatic latent image on an image carrier, the developing roller being set so that the circumferential speed s thereof has a range of $250 \leqq s \leqq 400$ [mm/s];

a layer regulating blade pressure contacting with the developing roller by the pressing force of 70–100 [gf/cm] to regulate uniformly a layer thickness of the developing agent that is supplied to the developing roller; and an elastic resin coat layer coated on the surface of the layer regulating blade, wherein the thickness t of the elastic resin is $10\times a \leqq t \leqq 50$ [$\mu$m] when the surface of the developing roller is formed of a metallic material whose surface roughness Rz is a [$\mu$m], and the layer regulating blade is made of a metallic material.

5. A developing device according to claim 4, wherein the surface of the developing roller is made of aluminum, brass, or stainless steel.

6. A developing device according to claim 4, wherein the elastic resin coat layer is an urethane rubber or silicon rubber coat layer.

7. A developing device comprising:

a developing roller configured to supply developing agent onto an electrostatic latent image on an image carrier; and a layer regulating blade pressure contacting with the developing roller to regulate uniformly a layer pressure of the developing agent that is supplied to the developing roller;

wherein the surface of the developing roller is made of brass, and the layer regulating blade is formed of stainless steel, and the pressing force of the layer regulating blade to the developing roller is 70–100 [gf/cm].

8. A developing device according to claim 7, wherein the circumferencial speed s of the developing roller is set $250 \leqq s \leqq 400$ [mm/s].

* * * * *